US005303543A

United States Patent [19]

Shah et al.

[11] Patent Number: 5,303,543

[45] Date of Patent: Apr. 19, 1994

[54] ANNULAR COMBUSTOR FOR A TURBINE ENGINE WITH TANGENTIAL PASSAGES SIZED TO PROVIDE ONLY COMBUSTION AIR

[75] Inventors: Nipulkumar Shah; Jack R. Shekleton, both of San Diego, Calif.

[73] Assignee: Sundstrand Corporation, Rockford, Ill.

[21] Appl. No.: 477,247

[22] Filed: Feb. 8, 1990

[51] Int. Cl.[5] ..... F02G 1/00

[52] U.S. Cl. ..... 60/39.36

[58] Field of Search ..... 60/39.36, 755, 760, 60/737, 738, 39.75, 39.83, 752

[56] References Cited

U.S. PATENT DOCUMENTS

| | | | |
|---|---|---|---|
| 3,490,747 | 1/1970 | De Corso et al. | 60/39.75 |
| 3,608,310 | 9/1971 | Vaught | 60/752 |
| 3,613,360 | 10/1971 | Howes | 60/39.36 |
| 4,151,709 | 5/1979 | Melconian et al. | 60/758 |
| 4,301,657 | 11/1981 | Penny | 60/759 |
| 4,739,621 | 4/1988 | Pettengill et al. | 60/39.83 |
| 4,825,640 | 5/1989 | Shekleton | 60/39.36 |

*Primary Examiner*—Richard A. Bertsch
*Assistant Examiner*—T. Thorpe
*Attorney, Agent, or Firm*—Wood, Phillips, VanSanten, Hoffman & Ertel

[57] ABSTRACT

Problems with the cooling of a turbine nozzle (60) and a turbine wheel (20) of a gas turbine engine when the engine is uprated may be avoided or minimized by employing a combustor (36) that is free of any means for providing cooling air films on the interior walls thereof and which allows the entry of only stoichiometric quantities of air into the interior of the combustor (36) at predetermined locations along the entire axial length thereof. Consequently, the entirety of the combustor (36) is available for combustion. Cooling of the nozzle (60) and components of the engine downstream thereof is handled by the provision of an annular array of small openings (102) immediately upstream of the leading edges (98) of the vanes (58) constituting the nozzle (60) to provide excellent mixing of dilution air and combustion gases thereat.

13 Claims, 2 Drawing Sheets

ANNULAR COMBUSTOR FOR A TURBINE ENGINE WITH TANGENTIAL PASSAGES SIZED TO PROVIDE ONLY COMBUSTION AIR

FIELD OF THE INVENTION

This invention relates to turbine engines, and more particularly, to a means by which the combustion flame zone of an annular combustor may be maximized to maximize power density.

BACKGROUND OF THE INVENTION

Thermal constraints are a typical limitation on the power that may be generated by air breathing gas turbine engines. Components such as the turbine nozzle and the vanes thereof as well as the turbine wheel and blades thereon cannot be subjected to gases of combustion at temperatures in excess of some predetermined temperature without either shortening the life of the engine or requiring resort to expensive, exotic materials which make the cost of manufacture of the engine uneconomical. Thus, for a gas turbine engine having a combustor of given size, the ultimate power output is not always so much limited by gas generating volume associated with combustion as by the ability of the design to allow operation without exceeding temperature limits at the turbine nozzle and the turbine wheel.

Recognition of this factor suggests that a given turbine engine could be uprated by increasing the combustor volume power density which can be obtained by maximizing the combustion flame zone within a given combustor volume.

One limitation on the combustion flame zone size resides in the physical location of the combustor walls with respect to each other and the combustor volume they define. Conventionally, an increased flame zone is attained by spreading the walls to increase the volume of the combustor. This, however, increases the size of the engine and in essence, is a re-design of a whole new engine as opposed to an uprating of an existing one. The other constraint on flame zone size is limitations on the amount of the combustor volume that is available for combustion. Conventionally, the total interior volume of the combustor is not available for combustion for the reason that various devices are employed on the interior walls to generate film air cooling of such walls to prevent the combustor itself from overheating or for otherwise introducing dilution air. Clearly, combustion cannot occur in those areas where film air cooling or the like is intended to occur without damaging the combustor and so the potential combustion flame zone for such a combustor is reduced by the volume devoted to the provision of means for providing film air cooling or the like.

The present invention is directed to using more of the combustion volume for combustion as well as to recovering that part of the volume of a combustor heretofore used for film air cooling and utilizing it to increase the combustion flame zone for that combustor, both without causing overheating of the combustor or the turbine nozzle or wheel. That in turn will increase the power density of the combustor which in turn will allow the gas turbine to be run with a greater output, that is, to be uprated and to be more economically manufactured.

SUMMARY OF THE INVENTION

It is the principal object of the invention to provide new and improved gas turbine engine. More specifically, it is an object of the invention to provide a gas turbine engine wherein the interior volume of the combustor is entirely devoted to the support of combustion to thereby provide an engine capable of developing greater power than an otherwise substantially identical gas turbine engine utilizing a conventional combustor.

An exemplary embodiment of the invention achieves the foregoing objects in a structure including a rotary compressor, a turbine wheel coupled to the compressor to drive the same, and an annular nozzle in proximity to the turbine wheel. The nozzle has a plurality of vanes disposed to direct gases of combustion at the turbine wheel. The vanes have leading edges remote from the turbine wheel and trailing edges adjacent the turbine wheel. An annular combustor is provided and has a radially outer wall, a radially inner wall spaced therefrom, and a radially extending wall interconnecting the inner and outer walls at a location remote from the nozzle. The inner and outer walls, at a location remote from the radially extending wall, define a combustor outlet throat which opens to the leading edges of the vanes. Means are provided for a plurality of axially spaced rows of tangentially directed passages formed in the outer wall and in fluid communication with the compressor for introducing combustion air into the combustor. The passages are sized to provide substantially only combustion air into the combustor to the substantial exclusion of dilution air. The combustor is otherwise free of any inlets in fluid communication with the compressor. Finally, means are provided at the throat and just upstream of the leading edges of the vanes which are in fluid communication with the compressor for introducing substantially all dilution air thereat and in a high velocity stream directed generally across the throat to achieve good mixing with combustion gases. This allows the combustion flame zone of the combustor to be maximized, and in turn allows increasing of the power density and an uprating of the output of the gas turbine engine.

As a preferred embodiment, the high velocity stream is made up of a multiplicity of small discrete streams.

In one embodiment, the combustor is contained within a case which in turn is in fluid communication with the compressor. The inner wall of the combustor is spaced radially outward of a part of the case so that dilution air may pass along the inner wall of the combustor. The introducing means include a series of openings in an annular array substantially at the leading edges of the nozzle vanes and which is located between the aforementioned part of the case and the inner wall of the combustor.

In a highly preferred embodiment, the turbine wheel is a radial turbine wheel and includes an annular, rear turbine shroud adjacent the turbine wheel and inwardly of the inner wall at the area of the throat. The series of openings is located between the inner wall and a radially outer part of the rear turbine shroud. The openings provide radially outwardly directed streams.

In a highly preferred embodiment, the openings are perforations in a continuation of the inner wall.

In a highly preferred embodiment, the tangentially directed passages are in the form of tubes and one of the rows is closely adjacent to the radially extending wall of the combustor. Another of the rows is closely adjacent to the throat. Because all of the rows are necessary to provide combustion air, complete combustion of fuel does not occur until the throat is reached thereby maximizing the volume of the combustor that is utilized to support combustion.

Other objects and advantages will become apparent from the following specification taken in connection with the accompanying drawings.

DESCRIPTION OF THE PREFERRED EMBODIMENT

Figure 1:
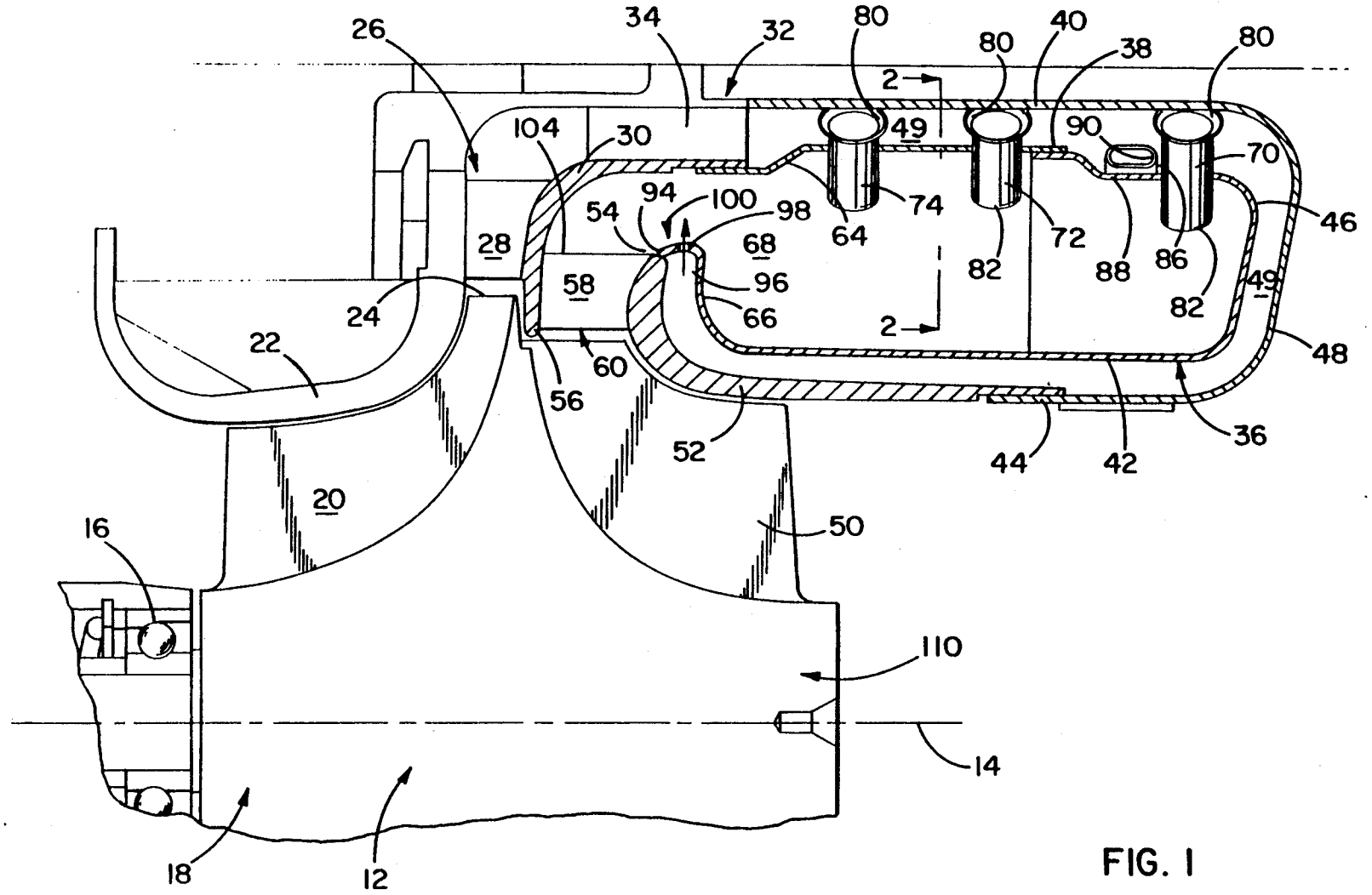
FIG. 1 is a fragmentary, sectional view of a gas turbine engine made according to the invention.

An exemplary embodiment of a gas turbine engine made according to the invention is illustrated in the drawings and will be described herein as a radial turbine. However, while the invention may be employed with the greatest efficacy in a radial turbine, it is not limited thereto but may be used in axial turbines as well.

Referring to FIG. 1, the gas turbine engine of the invention is seen to include a so-called monorotor, generally designated 12, mounted for rotation about an axis 14 by means of bearings fragmentarily illustrated at 16. The invention need not, however, be restricted to turbines having monorotors.

The monorotor 12 includes a rotary compressor section, generally designated 18 and a turbine wheel section, generally designated 20. Since the two are formed on a single rotor, it will be appreciated by those skilled in the art that the rotary compressor 18 is coupled to the turbine wheel 20 for rotation therewith.

The compressor 18 includes a series of blades 20 that rotate in close proximity to a fixed compressor shroud 22 and discharge at their radially outer ends 24 into a conventional vaned diffuser, generally designated 26, made up of a plurality of vanes 28, only one if which is shown. The vanes 28 are mounted to and extend between the compressor shroud 22 and a front turbine shroud 30.

Compressed air exiting the diffuser 26 is turned to flow in the axial direction by a case, generally designated 32, which may optionally include deswirler vanes 34. The case 32 is annular about the axis 14 and contains an annular combustor, generally designated 36. The combustor 36 includes a radially outer wall 38 which is located radially inwardly of a wall 40 of the case 32, a radially inner wall 42 which is radially outward of a wall 44 of the case 32 and a radially extending wall 46 axially spaced from a radially extending wall 48 of the case 32. As a consequence, the spaces between the foregoing walls are in fluid communication with each other and define a compressed air plenum 49 in fluid communication with the compressor 20 and extending entirely about the combustor 36.

The turbine wheel 20 includes a plurality of turbine blades 50 (only one of which is shown) which are mounted for rotation in close proximity to a rear turbine shroud 52 as is well known. The radially outer end 54 of the rear turbine shroud 52 is axially spaced from the radially inner end 56 of the front turbine shroud 30 and a plurality of vanes 58 (only one of which is shown in FIG. 1) defining an annular turbine nozzle, generally designated 60, extend therebetween. The vanes 58 receive hot gases of combustion from the combustor 36 and direct them against the blades 50 to drive the turbine wheel 20 as is well known.

The radially outer and inner walls 38 and 42 respectively of the combustor 36, at a location in close proximity to the nozzle 60 include converging sections 64 and 66 which together define an outlet throat 68 of the combustor 36 which is just upstream of the nozzle 60.

Figure 2:
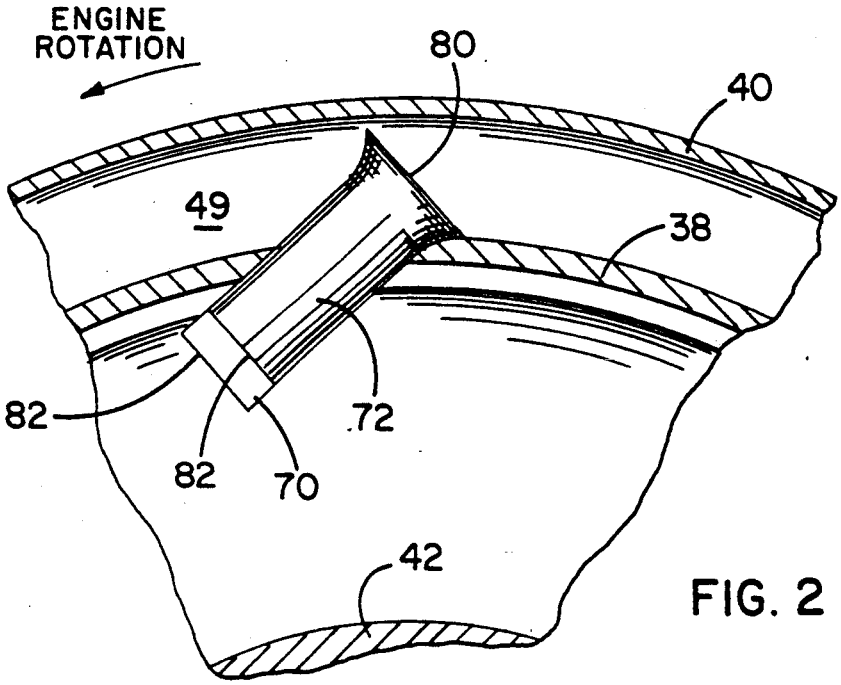
FIG. 2 is a fragmentary, sectional view taken approximately along the line 2—2 in FIG. 1.

Inlets to the combustor 36 consist of two, and preferably three, axially spaced rows of circumferentially spaced tubes 70, 72 and 74. The tubes in each of the three rows occupy a common plane that is transverse to the rotational axis 14 of the rotor 12 and will typically be equally angularly spaced. As best seen in FIG. 2, each of the tubes is mounted in the radially outer wall 38 of the combustor 36 and is directed circumferentially or tangentially at the space between the inner wall 42 and the outer wall 38. The tubes 70, 72 and 74 preferably are directed in the direction of engine rotation as indicated in FIG. 2. The radially outer ends 80 of each of the tubes 70, 72 and 74 are flared and open to the plenum 49 between the combustor 36 and the case 32 to receive compressed air from the compressor 20 and direct the same tangentially into the interior of the combustor 36. The interior ends 82 of the tubes 70, 72 and 74 are, of course open for this purpose.

It is to be particularly noted that the row of tubes 70 is closely adjacent a radially extending wall 46 of the combustor while the row of tubes 74 is closely adjacent the throat 68 of the combustor 36.

As seen in FIG. 1, each of the tubes 70 includes an opening 86 in a side wall thereof adjacent an annular, flattened tube 88 received in the plenum 49 between the walls 38 and 40. The flattened tube 88 is connected to the fuel supply for the turbine and includes openings 90 aligned with each of the openings 86 which serve as a simple means for injecting fuel into the interior of each of the tubes 70 where it may be air blast atomized.

An important feature of the present invention is the fact that the compressed air passages to the interior of the combustor 36 defined by the tubes 70, 72 and 74 are sized so that air entering the combustor 36 is only in sufficient quantity to stoichiometrically combust fuel injected into the combustor 36 and not to serve, in any appreciable way, as dilution air injectors as would be conventional. Additionally, the rows of the tubes 70, 72 and 74 are designed so that approximately equal air flow occurs thru each row. It is also significant to note that except for the tubes 70, 72 and 74, the walls 38, 42 and 46 of the combustor 36 are imperforate which is to say that they are free of any openings that are in fluid communication with the compressor 20. Consequently, the combustor 36 may be characterized as completely lacking any means for the introduction of dilution air in any appreciable measure to the interior thereof and as lacking any means for the generation of cooling air film or the like on the interior of the various walls making up the combustor 36.

Instead, the combustor 36 is cooled by flowing air from the compressor 20 through the plenum 49 between the case 32 and the combustor 36 about each of the combustor walls 38, 46 and 42 in that sequence. In this respect, it will be observed that a flange or end 94 of the converging inner wall section 66 defining the throat 68 is axially directed and located to abut the radially outer end 54 of the rear turbine shroud 52.

In the usual case, the combustor 38 will be made of sheet metal and the end 94 may be an integral extension of the radially inner wall 66 of the combustor 36, and specifically, an integral extension of the converging inner wall section 66. As can be readily ascertained from FIG. 1, the wall section 66 is axially spaced from the rear turbine shroud 52 in the vicinity of its radially outer end 54 to define a dilution air outlet area 96 for the plenum 49. The area 96 is aligned with the throat 68 and is intended to discharge all dilution air at this location in a direction that is generally across the throat 68 so as to achieve rapid and effective mixing with the products of combustion before they impinge upon the turbine nozzle 60 or the turbine wheel 20 and yet allow the entire volume of the combustor 36 to be available for combustion.

To achieve the desired mixing, a dilution air nozzle of annular configuration is provided to direct a high velocity stream of air as illustrated by an arrow 98 in FIG. 1 in the radially outward direction. This nozzle is generally designed 100 and is defined by a series of small openings that face in the radial direction and which are formed in the end 94 of the radially inner wall 42 of the combustor 36. In the usual case, the openings 102 will be formed as perforations in the sheet metal defining the end 94.

The total cross sectional area of the openings 102 is chosen to be less than the minimum cross sectional area of the flow path defined by the plenum 49. This in turn means that dilution air passing through the nozzle 100 into the throat 68 will be accelerated into a high velocity stream made up of a plurality or multiplicity of small, discreet streams that moves radially outwardly deeply into the gases of combustion which are moving axially as well as circumferentially through the throat 68 at this point in time. This assures that rapid and complete mixing occurs so as to lower the temperature of the gases of combustion to a value whereat damage to the turbine nozzle 60 or the turbine wheel 20 will not occur. It is to be particularly observed that in a radial turbine such as that illustrated, because of the fact that the dilution air stream is moving in the radial direction and the leading edges 104 of the vanes 58 extend in the axial direction, that the path of travel of the combustion gases from the throat 68 to the leading edges 104 adjacent the front turbine shroud 30 is longer to enable more thorough mixing of the dilution air with the gases of combustion. In particular, because of velocities involved, it will be readily appreciated that the velocity of the dilution air in the radial direction across the throat 68 will begin to decay as the dilution air moves radially outwardly and as the dilution air stream is accelerated in the axial direction by the gases of combustion. The particular geometric construction whereby the combustion gases are rotated essentially 90 degrees provides additional gas travel time to assure that the decaying dilution air stream is thoroughly mixed with the length of the gas flow path being increased proportionately to the radial distance from the nozzle 100.

Figure 3:
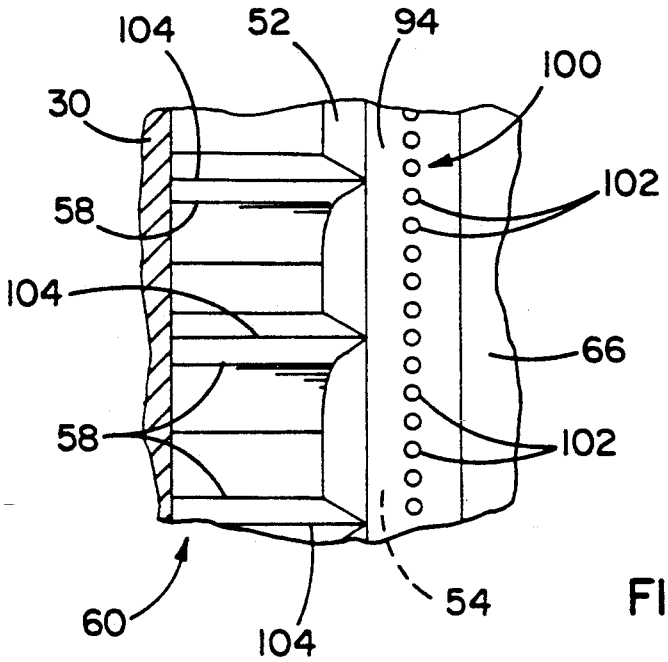
FIG. 3 is a fragmentary, developed view of the turbine nozzle from the radially outer side thereof.

While FIG. 3 illustrates a multiplicity of the openings 102 for each of the vanes 58, the invention contemplates that there may be as few as one opening 102 for each of the vanes 58. In such a case, in taking into account the fact that the gases of combustion will be moving circumferentially as well as axially, the opening 102 for a given vane 58 may be located somewhat upstream in the direction of swirl so that dilution air emanating therefrom, after being redirected by the gases of combustion, will impinge upon corresponding vane 58.

It is also noted that in some instance, it may be desired to provide dilution air inlets (not shown) in the front turbine shroud 30 to provide enhanced cooling of the front turbine shroud ends of the vanes 58 and the invention is intended to be applicable to such a variation. Indeed, when the invention is employed in an axial flow turbine, dilution air may be directed across the throat 68 from both sides thereof, and not just from the radially inward side as shown. In the usual case, the number of openings 102 will be large as a consequence of their relatively small size and typically substantially more in number than the number of the vanes 58. Advantageously, the number of the openings 102 may be a multiple of the number of the vanes 58 so that at least one opening may be aligned upstream of a corresponding vane 58 to assure good cooling thereof.

Since the combustion air passages defined by the tubes 70, 72 and 74 are configured to provide substantially only the combustion air that is required for stoichiometric combustion, it follows that combustion will not be complete until the burning gases mix with the last of the air being introduced, which introduction occurs through the tube 74 immediately adjacent to throat 68. Because the tubes 70 are closely adjacent to radially extending wall 46, the full axial length of the combustor 36 is available for use as a combustion flame zone. Furthermore, virtually the entire radial dimension of the combustor 36 is likewise available for use as a combustion flame zone since the interior walls of the combustor 36 are not swept with cooling air films. As a consequence, the volume within the combustor 36 available for combustion is maximized, thereby allowing a greater amount of fuel to be burned therein per unit of time. The cooling problems that might ordinarily be incurred as a result are obviated through the device of passing the dilution air about the entirety of the combustor 36 to provide external wall cooling thereof and injecting such dilution air at the throat 68 immediately upstream of the components, such as the nozzle 60 and turbine wheel 20, requiring protective cooling. As a consequence, the power output of the gas turbine is increased, manufacturing costs are lowered and the turbine itself uprated.

We claim:

1. A gas turbine engine comprising;

a rotary compressor;

a turbine wheel coupled to said compressor to drive the same;

an annular nozzle in proximity to said turbine wheel and having a plurality of vanes disposed to direct gases of combustion at said turbine wheel, said vanes having leading edges remote from said turbine wheel and trailing edges adjacent said turbine wheel;

an annular combustor having a radially outer wall, a radially inner wall spaced therefrom and a radially extending wall interconnecting said inner and outer walls remote from said nozzle, said inner and outer walls, at a location remote from said radially extending wall defining an outlet throat opening to the leading edges of said vanes;

means for injecting fuel into the combustor;

a plurality of axially spaced rows of tangentially directed passages formed in said outer wall and in fluid communication with said compressor for introducing combustion air into the combustor, said passages being sized to provide substantially only combustion air to the substantial exclusion of dilution air into said combustor and said combustor otherwise being free of any inlets in fluid communication with said compressor; and means at said throat and just upstream of said leading edges and in fluid communication with said compressor for introducing substantially all dilution air thereat in a high velocity stream directed across said throat to achieve necessary dilution thereat to allow the combustion flame zone of said combustor is maximized.

2. The gas turbine of claim 1 wherein said velocity stream is made up of a multiplicity of small discrete streams.

3. The gas turbine of claim 2 wherein said combustor is contained within a case which in turn is in fluid communication with said compressor, said inner wall being spaced radially outward of a part of said case so that dilution air may pass between said inner wall and said case, said introducing means including a series of openings substantially at said leading edges in an annular array which is located between said part of said case and said inner wall.

4. The gas turbine of claim 3 wherein said turbine wheel is a radial turbine wheel and including an annular rear turbine shroud adjacent said turbine wheel and inwardly of said inner wall at said throat, said series of openings being located between said inner wall and a radially outer part of said rear turbine shroud, the openings of said series facing at least somewhat in the radial direction.

5. A gas turbine engine comprising;

a rotary compressor;

a turbine wheel coupled to said compressor to drive the same;

an annular nozzle in the proximity to said turbine wheel and having a plurality of vanes disposed to direct gases of combustion at said turbine wheel, said vanes having leading edges remote from said turbine wheel and trailing edges adjacent to said turbine wheel;

an annular combustor having a radially outer wall, a radially inner wall spaced therefrom and a radially extending wall interconnecting said inner and outer walls remote from said nozzle, said inner and outer walls, at a location remote from said radially extending wall converging to define an outlet throat opening to the leading edges of said vanes;

means for injecting fuel into the combustor;

a plurality of axially spaced, circumferential rows of tangentially directed passages formed in said outer wall and in fluid communication with said compressor for introducing combustion air into the combustor, said passages being sized to provide substantially only combustion air to the substantial exclusion of dilution air to said combustor and said combustor otherwise being free of any inlets in fluid communication with said compressor;

means in fluid communication with said compressor and defining a fluid flow path about said combustor and having a discharge passage of lesser cross sectional area than said fluid flow path and located immediately upstream of said leading edges, said discharge passage directing air from said compressor generally across said throat.

6. The gas turbine engine of claim 5 wherein one of said rows is axially adjacent said radially extending wall and another of said rows is closely adjacent said throat

7. The gas turbine engine of claim 6 wherein there are three said rows, including an intermediate row between said one row and said another row; and said fuel injection means injects fuel through the passages in said one row.

8. The gas turbine engine of claim 7 wherein said tangentially directed passages are defined by tubes.

9. A radial gas turbine engine comprising:

a rotary compressor;

a radial turbine wheel coupled to said compressor to drive the same;

an annular nozzle disposed said turbine wheel and having a plurality of vanes arranged to direct gases of combustion radially inwardly and at said turbine wheel, said vanes having leading edges remote from said turbine wheel and trailing edges adjacent said turbine wheel;

an annular combustor having radially outer, radially inner, and radially extending wall sections, said inner and outer wall sections at a location remote from said radially extending wall section defining an outlet throat opening to the leading edges of said vanes;

means for injecting fuel into the combustor;

a plurality of axially spaced, circumferential rows of tangentially directed tubes mounted in said outer wall and in fluid communication with said compressor for introducing combustion air into the combustor, said tubes being sized to provide substantially only combustion air to the substantial exclusion of dilution air into said combustor and said combustor otherwise being free of any inlets in fluid communication with said compressor, one of said rows being closely adjacent said radial extending wall and another of said rows being closely adjacent said throat; and an annular series of radially facing openings at said throat and just upstream of said leading edges and in fluid communication with said compressor for introducing substantially all dilution air in the radially outward direction thereat whereby the combustion flame zone of said combustor is maximized.

10. The radial gas turbine engine of claim 9 wherein said combustor is contained within a case which in turn is in fluid communication with said compressor, said inner wall section being spaced radially outward of a part of said case so that dilution air may pass between said inner wall section and said case, said introducing means including an annular outlet substantially at said leading edges and extending to said case between said part and said inner wall section; and an annular dilution nozzle facing generally radially outward and located over said annular outlet.

11. The radial gas turbine engine of claim 10 wherein said annular dilution nozzle is formed of an annular array of openings in a solid element.

12. The radial gas turbine engine of claim 11 wherein said solid element is sheet metal and said openings are perforations in said sheet metal.

13. The radial gas turbine engine of claim 12 wherein said solid element is a continuation of said inner wall section.

* * * * *